United States Patent [19]

Meier et al.

[11] 4,062,325

[45] Dec. 13, 1977

[54] BOILER USING COMBUSTIBLE FLUID

[75] Inventors: John G. Meier, San Diego, Calif.; Bernard Vollerin, Geneva, Switzerland

[73] Assignee: Pietro Fascione, Italy

[21] Appl. No.: 731,014

[22] Filed: Oct. 8, 1976

Related U.S. Application Data

[63] Continuation-in-part of Ser. No. 628,148, Nov. 5, 1975, abandoned, which is a continuation of Ser. No. 485,639, July 3, 1974, abandoned.

[30] Foreign Application Priority Data

July 11, 1973 Switzerland ..... 10085/73

[51] Int. Cl.[2] ..... F22B 7/00; F22B 25/00

[52] U.S. Cl. ..... 122/225 R; 122/149

[58] Field of Search ..... 122/136 R, 149, 210, 122/223, 225 R, 226, 227, 228

[56] References Cited

U.S. PATENT DOCUMENTS

| | | | |
|---|---|---|---|
| 2,136,125 | 11/1938 | Waudby | 122/210 |
| 2,278,699 | 4/1942 | Joroleman | 122/225 |
| 2,370,145 | 2/1945 | Carter | 122/136 |
| 3,080,119 | 3/1963 | Shutkufski | 237/66 X |
| 3,187,726 | 6/1965 | Van Der Martin | 122/149 |

*Primary Examiner*—Kenneth W. Sprague

*Attorney, Agent, or Firm*—Robert E. Burns; Emmanuel J. Lobato; Bruce L. Adams

[57] ABSTRACT

A fluid fuel boiler having a combustion chamber having an opening for introducing a combustion supporting gaseous fluid. A burner introduces a liquid fuel into the combustion chamber mixed with the gaseous fluid for combustion thereof. Water-heating flow paths are disposed circumferentially and axially of the combustion chamber. Axial hot gas flow paths deliver hot gases from a downstream portion of the combustion chamber to a plurality of nozzles for diverting some of the hot gases along axially spaced paths in a direction circumferentially of the combustion chamber. These latter hot gas flow paths are immersed in the flow paths of the water to improve heat transfer.

9 Claims, 9 Drawing Figures

4
29
28
32
28
2
24
26
27
31
30
25
10'
23
16
9
13
21
3a
22
15'
IV
II
III
3
3
3
12
8
10
18
17
7
θ
1
5
37
37
36
6

3a
16
20
18
21

BOILER USING COMBUSTIBLE FLUID

BACKGROUND OF THE INVENTION

This invention relates generally to boilers and more particularly to a new and improved modular boiler.

It is known that the coefficient of heat transfer of a conduit for transferring heat from hot gases to water passing through a boiler is a function of the turbulence of the gases in the heat-transfer or convection conduits. In known boilers, this turbulence of the gases is relatively slight and is increased in practice only by the interposing of baffles distributed along the heat-transfer or convection conduits. In order to lower the temperature of the gases to about 100° to 150° C at the time that they are evacuated towards the stack, the length of the heat-transfer or convection conduits must be relatively large. Since the price of boilers is substantially proportional to the weight of the cast iron used for their manufacture, the great advantage which may exist in increasing the power and reducing the length of the heat-transfer or convection channels by increasing the heat-transfer coefficient will be readily understood.

Boilers whose combustion chamber is connected to the heat-transfer or convection channels by nozzles which generate head losses are available on the market. These nozzles have the effect of considerably increasing the velocity of the hot gases due to their small cross section, producing a large increase of movement of the hot gases in the heat-transfer or convection channels. Localized loss in head created by each nozzle makes it possible to pressurize the combustion chamber and make the range of velocities of the gases, their temperature and their pressure less dependent on external conditions.

Unfortunately in these embodiments the nozzles are concentrated in the same place in the combustion chamber and each of them injects the hot gases into a separate heat-transfer or convection channel. The concentrating of the nozzles at the same place produces thermal stresses which are very poorly distributed due to the presence of hot points at the place of concentration of the nozzles. Since the injection of the gases takes place near the upstream end of each channel, the secondary movements of the gases which are produced by the injection rapidly decrease due to the friction of the gases in these channels. This decrease and the fact that each nozzle injects the gases at one end of each channel causes the heat transfer coefficients to decrease between the upstream and downstream ends of the heat-transfer or convection channels.

SUMMARY OF THE INVENTION

An object of the present invention is to remedy these drawbacks of the known boilers, at least in part, so as to increase the power and the coefficient of heat transfer. The measures taken have the effect of decreasing the size of the boiler and therefore its weight as compared with the existing boilers of comparable power.

For this purpose, the present invention relates to a fluid fuel boiler comprising a combustion chamber formed of sidewalls, a bottom, and a cover which has an opening for a burner. A water circulation circuit surrounds the combustion chamber and connects a source of cold water to a hot water collector. At least one heat-transfer or convection conduit is in contact with the circuit and connects the combustion chamber to at least one exhaust gas collector. This boiler is characterized by the fact that the chamber is placed in communication with the conduit by a plurality of injection nozzles disposed circumferentially of the combustion chamber and in some embodiments also axially thereof.

The presence of a plurality of injection nozzles between the combustion chamber and the heat-transfer or convection ducts connecting the chamber to one or more exhaust gas collectors has effects which - as will be explained subsequently - make it possible to achieve the above-indicated goals. These nozzles first of all create losses in the head which are capable of reducing pressure waves in the combustion chamber and therefore make it possible to increase the power of the boiler without increasing the size of the combustion chamber.

These injection nozzles strongly accelerate the gases introduced into the heat-transfer or convection ducts, producing a substantial contribution of appreciable movement and an intense mixing of the gases in these ducts. It is due to this stirring of the gases that the heat transfer coefficient is increased and that the length of the convection or heat-transfer ducts can be reduced proportionally to this increase.

Other features and advantages will become evident from the following description. This description refers to a boiler of a specific type. It should immediately be pointed out that the invention can be used with other types of boilers, in particular with boilers provided with a conventional cover and not necessarily having an expansion vessel which can be dissociated from the boiler.

BRIEF DESCRIPTION OF THE DRAWINGS

The accompanying drawings show, by way of example, one embodiment of the boiler forming the object of the present invention.

DESCRIPTION OF THE PREFERRED EMBODIMENTS

Figure 1:
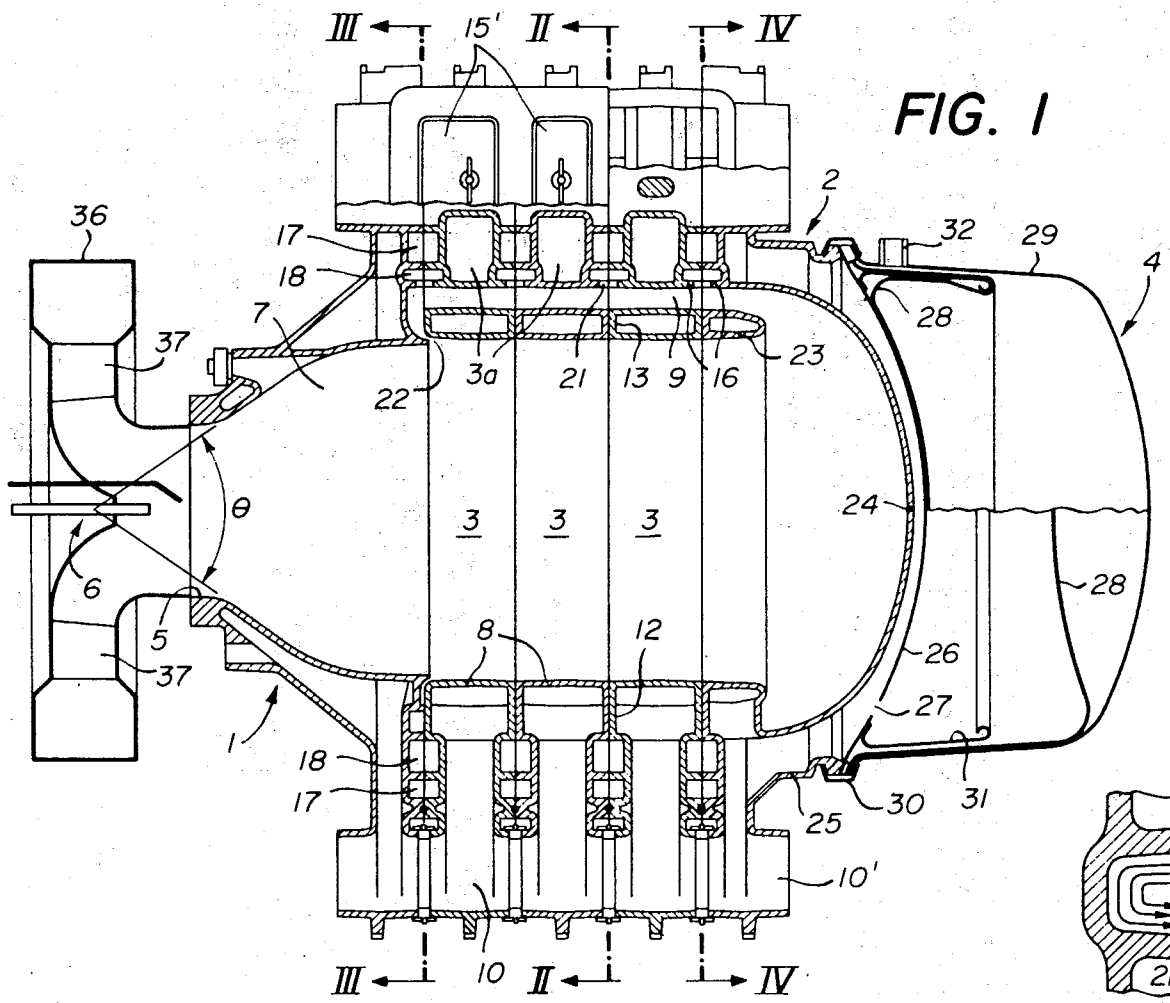
FIG. 1 is a sectional view of a boiler according to the invention and taken along the section line I—I of FIG. 2.

The boiler shown in FIG. 1 is a modular boiler which comprises a hollow cover 1, a bottom 2, three intermediate annular elements 3, and an expansion vessel 4 fastened to the boiler bottom 2. The cover 1 has an opening 5 adapted to receive a fuel burner 6. This opening 5 communicates with a combustion chamber 7 formed by the inner walls of the cover 1 and of the bottom 2 as well as by the central openings 8 provided through each of the intermediate annular elements 3. The inner wall of the cover 1 has a shape whose aerodynamic properties have been designed for a purpose which will be explained further below. The bottom of the boiler, which closes off the combustion chamber 7, provides access to six ducts 9 having the shape of annular segments, which are concentric with the longitudinal axis of the combustion chamber 7.

Figure 2:
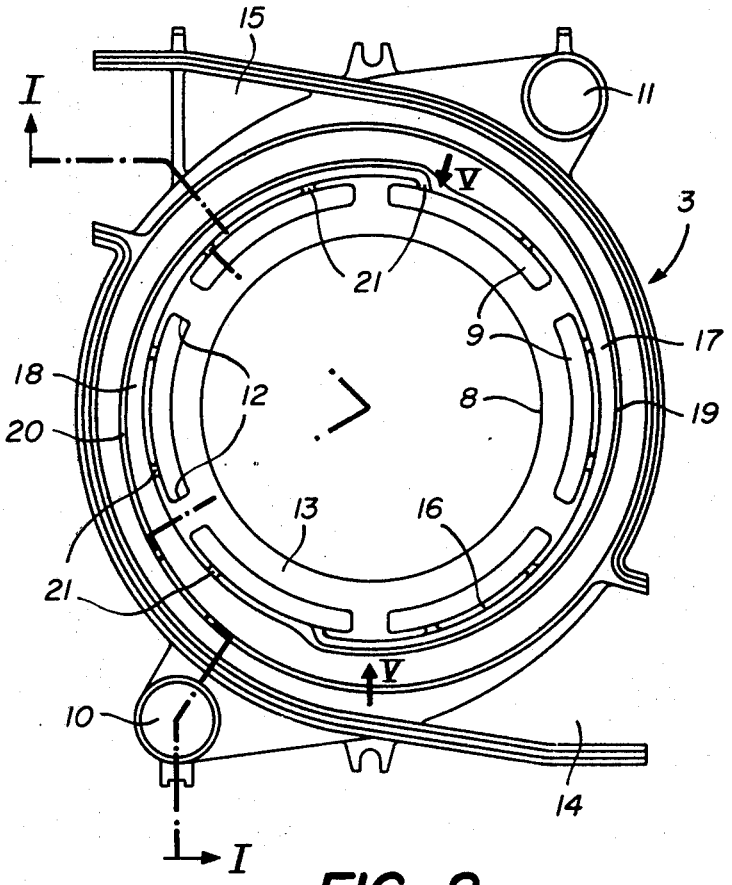
FIG. 2 is a sectional view taken along the section line II—II of FIG. 1.

Before describing the boiler in further detail, an intermediate element 3 will be described with reference to FIG. 2. This element, shown in elevation view in FIG. 2 is of generally annular shape. On this element there can be noted the central opening 8 thereof as well as the six ducts 9 circumferentially spaced. The opening 8 and the ducts 9 extend through the element 3 which extends between two parallel planes perpendicular to the axis of the opening 8 and thereby normal to the axis of the combustion chamber. Each annular intermediate element is a hollow cast iron body produced by casting. The circumferential space 3*a* (FIGS. 1 and 5) of this hollow element communicates with two openings or conduits 10 and 11 which are diametrically opposite each other with respect to the opening 8 and pass through each element 3 parallel to the axis of the central opening 8. The opening of the conduit 10 is connected to the cold water feed circuit while the opening of the conduit 11 is connected to the hot water distribution circuit. Six radial segments 12 provided between the ducts 9 connect the body of the element 3, that is to say the portion located outside the ducts 9, to an inner ring 13 which surrounds the central opening 8. These radial segments 12 and the ring 13 are hollow on the inside so that they communicate with the inner space 3*a* located at the periphery of the ducts 9.

As shown in FIG. 1, the ring 13 extends over the entire width or length of the intermediate element 3 so that these rings 13 are assembled alongside of each other. This is not true of the portion of these elements 3 which extends along the periphery of the ducts 9. In this portion, the hollow space does not extend over the entire width or length of the element, the rest of this width or length being occupied by the three ribs 16, 19 and 20 provided on each of the two faces of the element and intended to form convection or heat-transfer conduits 17 and 18 between the ducts 9 and the exhaust gas collectors 14 and 15 respectively which are diametrically opposite each other with respect to the axis of the combustion chamber 7. These collectors are closed by covers only some of which, 15′, are visible in FIG. 1. As can be seen from this FIG., the convection or heat-transfer conduits 17, 18 alternate with the inner spaces 3*a* of the elements 3.

If one refers again to FIG. 2; it will be noted that the provision of the conduits 17 and 18 is obtained by means of two spiral ribs 19 and 20 which are 180° apart from each other and extend around a circular rib 16 forming the periphery wall of the ducts 9. Each of these ducts is connected to the conduits 17 or 18 or even to both of these conduits by two injection nozzles 21 extending over a portion of the length of the conduit, for the purposes which will be explained subsequently.

Figure 3:
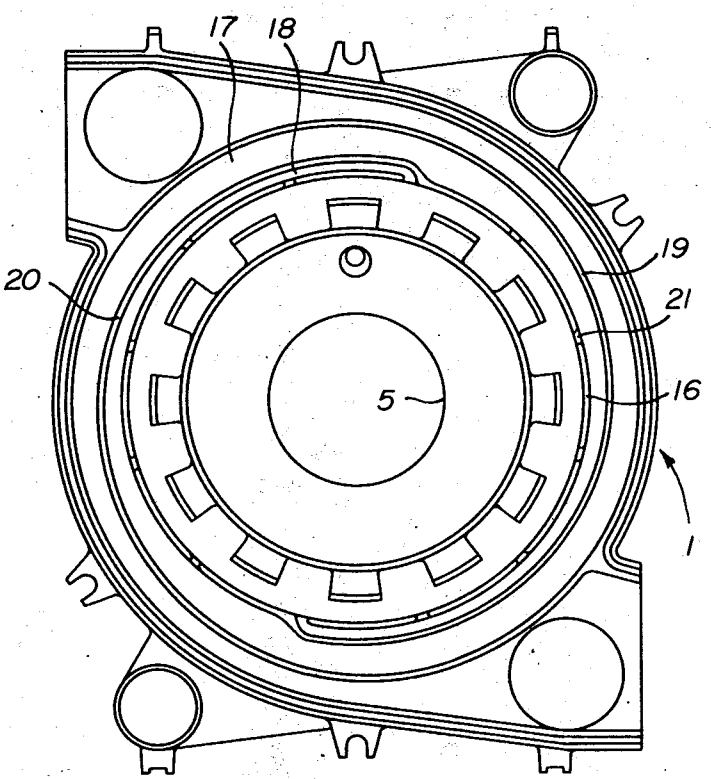
FIG. 3 is a sectional view taken along the section line III—III of FIG. 1.

From FIGS. 1 and 3 it can be noted that a series of hot gas reinjection spaces 22, distributed over the same circumference, is formed between the cover 1 and the inner ring 13 of the first modular element 3 adjacent the cover. These hot gas reinjection spaces 22 cause the downstream ends of the ducts 9 to communicate with the combustion chamber 7 so as to permit the reinjection of a certain amount of hot gases upstream in the combustion chamber and better balance the pressure in the ducts 9. The temperature of the burned gases thus becomes more uniform in these ducts, so that the heat transfer is better distributed. This reinjection favors blue-flame combustion which gives better efficiency and is less noisy than yellow-flame combustion.

This film of gas is thus reinjected along the wall of the chamber 7 in a zone which is particularly exposed by virtue of the temperature of the flame. As the reinjected gases are not as hot as the flame, they form a protective film locally. This is of particular importance when the boiler is provided with a cover such as that shown, which, as will be seen subsequently, causes the flame to hug the wall of the chamber. In this case, particularly if the boiler is powerful and has numerous intermediate elements 3, it is advisable that the film of reinjected gas at least partially prevent the flame from coming into contact with this wall and make it possible to avoid reactions between the flame and the carbon of the cast iron of the walls of the combustion chamber.

Finally, the internal recirculation of the burned gases causes a diluting of the gases in the boiler and leads to a reduction in the rate of formation of $NO_x$.

The bottom 2 of the boiler also has an inner ring 23. The six ducts 9 having the shape of annular segments, commence between this inner end ring 23 and a wall 24 which closes off the chamber 7. Like the other rings 13, the end ring 23 communicates on the one hand with an opening 10′ and on the other hand with an opening 11′. These openings are located in the extension of the openings 10 and 11 respectively, thus forming a conduit for the distribution of cold water to the boiler and a hot water collector respectively.

The bottom 2 also has an annular wall 25 which extends around the wall 24 and creates a path for communication with the openings 10′ and 11′. This annular wall 25 is intended for attachment of the expansion vessel 4. The expansion vessel 4 has a wall 26 provided with a small opening 27 and is fastened in an airtight manner to the end of the annular wall 25 thus forming, except for the opening 27, a closed space between the walls 24 and 26. The expansion vessel has a diaphragm 28 whose edges are clamped between the edge of the wall 26 and the edge of a receptacle 29. These three elements are assembled on the annular wall 25 by a fastening collar 30. A guide ring 31 is fastened to the back of the wall 26, concentric to the sidewall of the receptacle 29, and constitutes a guide support when the diaphragm 28 is deflected towards the wall 26. This expansion vessel 4 also has an opening 32 through the wall of the receptacle 29, which serves to introduce a fluid between the diaphragm 28 and the receptacle in order to exert a certain pressure on the diaphragm 28.

The burner 6 is mounted coaxially with the combustion chamber 7. It has a spiral supply well 36 fastened in the opening 5 of the cover 1. This well 36 is provided with vanes 37 intended to impart a pre-rotation to the jet of recirculated gases and air entering the combustion chamber 7. The well is connected to the recirculation device for the burned gases (not shown), which is connected to one of the exhaust collectors 14 and 15.

In operation, the combustion gases produced in the combustion chamber 7 enter into the six ducts 9 having a shape of annular segments and flow in a direction toward the cover 1. As they advance in the ducts 9, the combustion gases enter the spiral conduits 17 and 18 via the injection nozzles 21 provided through the circular ribs 16. These spiral conduits 17 and 18 guide the combustion gases towards the exhaust collectors 14 and 15 respectively. One of the collectors is connected to the stack while the other is connected to the burner by a recirculation circuit (not shown). As has already been stated, the downstream ends of the channels of the ducts 9 communicate with the combustion chamber 7 via the series of hot gas reinjection spaces 22. Thus a part of the combustion gases is reinjected into the combustion chamber through the hot gas reinjection spaces 22. This reinjection, as well as the recirculation of the gases in the burner, assumes blueflame combustion.

Various works have shown the curvature effect of a conduit of a given length on the flow of a fluid in said conduit. This curvature effect causes secondary movements within the flow in a plane perpendicular to the direction of advance of the fluid. The arrows included in the sectional view of such a conduit, shown on a larger scale in FIG. 6, indicate the path of these secondary movements. Now, these secondary movements greatly increase the heat transfer between the fluid and the walls of the conduit. They come from the centrifugal effect caused by the curvature, which effect is substantial only if the Dean's number of the flow is greater than a certain maximum. This maximum is a function of the Prandtl (Pr) number of the fluid, given by the ratio of the kinematic viscosity of the fluid to the thermal diffusivity of this fluid. The Dean's number is defined by the formula:

$$De = Re\sqrt{(D_H)/2 \times Rc)}$$

in which Re is the Reynolds number of the flow; $D_H$ is the hydraulic diameter of the duct; Rc is the radius of curvature of the duct.

By way of example, it may be stated that for a gas or a gaseous mixture in which Pr is of the order of 0.7, the minimum Dean's number which must be present in order for the secondary movements to be substantial is about ten. If Pr is about five (as in the case of water) De min is about five and if Pr is about thirty (as in the case of a light oil), De min is about unity.

The presence of the injection nozzles 21, located along the inner face of the spiral convection conduits, has the effect of locally reinforcing these secondary movements by a factor which is a function of the difference between the velocities produced by the curvature, along the direction of the radius of curvature, and the velocity of injection. It can be said that if a flow of gas is injected through the nozzles extending through the inner face of the curvature (see FIG. 6) at a velocity twenty times greater than the secondary velocities produced by the curvature, the reinforcement factor of the curvature effects is of the order of 2, which is considerable.

The secondary movements effectively distribute the injected gases and make the temperature field at the periphery of the spiral duct more uniform. This results in a greater transfer of heat and a decrease in the thermal stresses in the metal.

It has been stated that the cross section of the difficult injection nozzles 21 decreases from nozzle to nozzle in the downstream direction of the spiral convection or heat-transfer conduits 17 and 18. This feature takes into account the losses in head present upon going from the upstream end toward the downstream end of these conduits and makes it possible to obtain uniform rates of flow for all of the injection nozzles.

Aside from the curvature of the convection ducts, the existance of the nozzles has several advantages, particularly the advantage of making the weight rate of flow uniform between the different elements 3 so that the last element will have substantially the same rate of flow as the first element, and moreover of maintaining an intense turbulence in the convection conduits, thus increasing the heat transfer coefficient, and finally of reinjecting hot gases into the gases which have already cooled down, which increases the average temperature of the gases and therefore the flow of heat transferred from the gases to the water.

One will also note the equiangular arrangement of the nozzles with respect to the longitudinal axis of the combustion chamber 7, which distributes the hot points in the metal uniformly, better distributing the thermal stresses.

Figure 5:
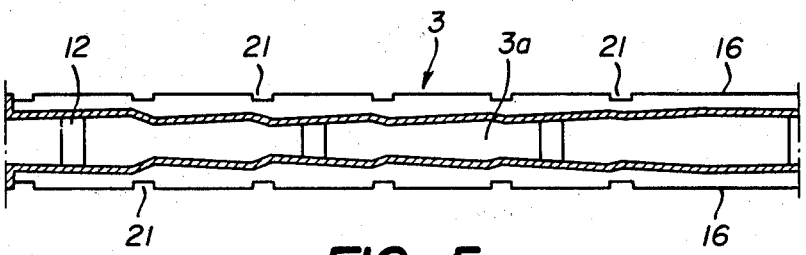
FIG. 5 is a developed view along the section line V—V of FIG. 2.

It will furthermore be noted from FIG. 5 that the cross section of the convection or heat transfer ducts decreases from one nozzle 21 to the next, then increases suddenly again at each nozzle. This cross section is selected so as to take into account the decrease in volume of the gases as a result of the cooling down thereof and the new conditions resulting from each reinjection. This cross section is therefore calculated so as to maintain a substantially constant velocity of flow of the gases in the convection or heat-transfer ducts.

While the combustion gases flow spirally in two separate streams between each element 3, the flow of the water takes place within these elements from the opening or conduit 10 to the opening or conduit 11. A part of the cold water entering into the inner space **3*a* of the intermediate elements 3 passes into the ring 13 via the radial segments 12 connecting the body of the element 3** to said ring.

Upon the placing in operation of the boiler, a certain pressure is created in the expansion vessel 4 between the receptacle 29 and the diaphragm 28 by introducing a gas under pressure through the opening 32, which is then hermetically closed. When the water is introduced, the pressure within the expansion vessel 4 is equalized via the opening 27. This arrangement of the expansion vessel is advantageous due to the fact that it makes it possible to integrate it in the boiler, thus forming a more compact installation.

During the course of the description mention has already been made of certain advantages of the boiler which is the object of the present invention. Still others may be mentioned which make it possible to solve many problems posed by the boilers on the market today.

Among such advantages, it may first of all be mentioned that the flow of the combustion gases between the ducts 9 and the collectors 14 and 15 takes place via convection or heat-transfer ducts 17, 18, connected in parallel to the ducts 9. This arrangement of the convection conduits in parallel is extremely important due to the fact that it makes it possible to adapt the area of the cross section of passage of the combustion gases to the power of the boiler.

Each modular element is provided with two convection or heat-transfer conduits 17, 18 which lead to two exhaust collectors 14 and 15, which makes it possible to effect the recirculation of the exhaust gases coming from one of the two collectors.

As can be noted particularly well from the cross sectional views of the boiler, its Geometry is symmetrical both with respect to the water, feed, and discharge conduits and with respect to the convection or heat-transfer conduits and the exhaust collectors. This symmetry makes it possible to have uniformly distributed specific heat loads, thus avoiding strong internal stresses in the cast iron.

From these same cross sectional views of the boiler it can also be seen that the second half of each convection or heat-transfer conduit, located downstream of the nozzles 21 which discharge into the conduits, decreases in cross section as one approaches the exhaust collectors 14 and 15. As the cooling of the gases leads to a decrease in their specific volume, their absolute pressure remaining substantially constant, this decrease in cross section makes it possible to make the velocity of these gases uniform and contributes to a good heat transfer. Turbulence generators (not shown) can also be placed in these conduits. This measure is however optional.

FIG. 1 shows that the ribs 16, 19 and 20 forming the convection or heat-transfer conduits 17 and 18 constitute heat transfer vanes for the water circulation ducts.

It has been mentioned that the inner wall of the hollow cover 1 is of a special shape which, starting at the opening 5, provides a space of progressively increasing cross section of generally frusto-conical shape with an angle of between 30° and 110°. This cover 1 closes the combustion chamber 7 which is cylindrical. The conical portion connecting the opening 5 to the cylindrical chamber 7 is cooled by the circulation of water within the hollow cover. Moreover, the pre-rotation imparted to the feed gases by the vanes of the spiral well 36 imparts to these gases or to the gas-liquid mixture a turbulent movement which follows the conical portion of the cover. The value of the angle $\theta$ is selected as a function of the angular speed imparted to these gases or to the gas-liquid mixture. The inner shape of the cover 1 has the advantage of eliminating the dead eddyings which occur in the corners of vantage of eliminating the dead eddying which occur in the corners of boilers with flat covers. This conicity makes it possible to stabilize the flow and to elongate the flame, which spreads out on the periphery of the combustion chamber, located in the extension of the conical portion of the cover. The temperature of the flame is made more uniform and the volume of radiating burned gases is greater, which increases the heat transfer to the wall of the combustion chamber 7.

The elimination of the dead eddying which takes place in boiler with a flat cover at the corner between said cover and the combustion chamber, decreases the total loss in head of the boiler and increases the transfer of heat by radiation. This is due to the fact that the dead eddy is relatively cold and constitutes a screen against the radiation of the flame.

The suppression of this dead eddy therefore makes it possible to utilize the volume provided within the hollow cover in order to increase the total exchange surface of the boiler. Another reason for this circulation of water in the cover is that the water lowers the temperature of the surface of the cover. This cooling of the wall of the cover reduces the formation of nitrogen oxides $NO_x$ by the action of heat and reactions between the flame and the carbon of the cast iron of the cover.

Figure 7:
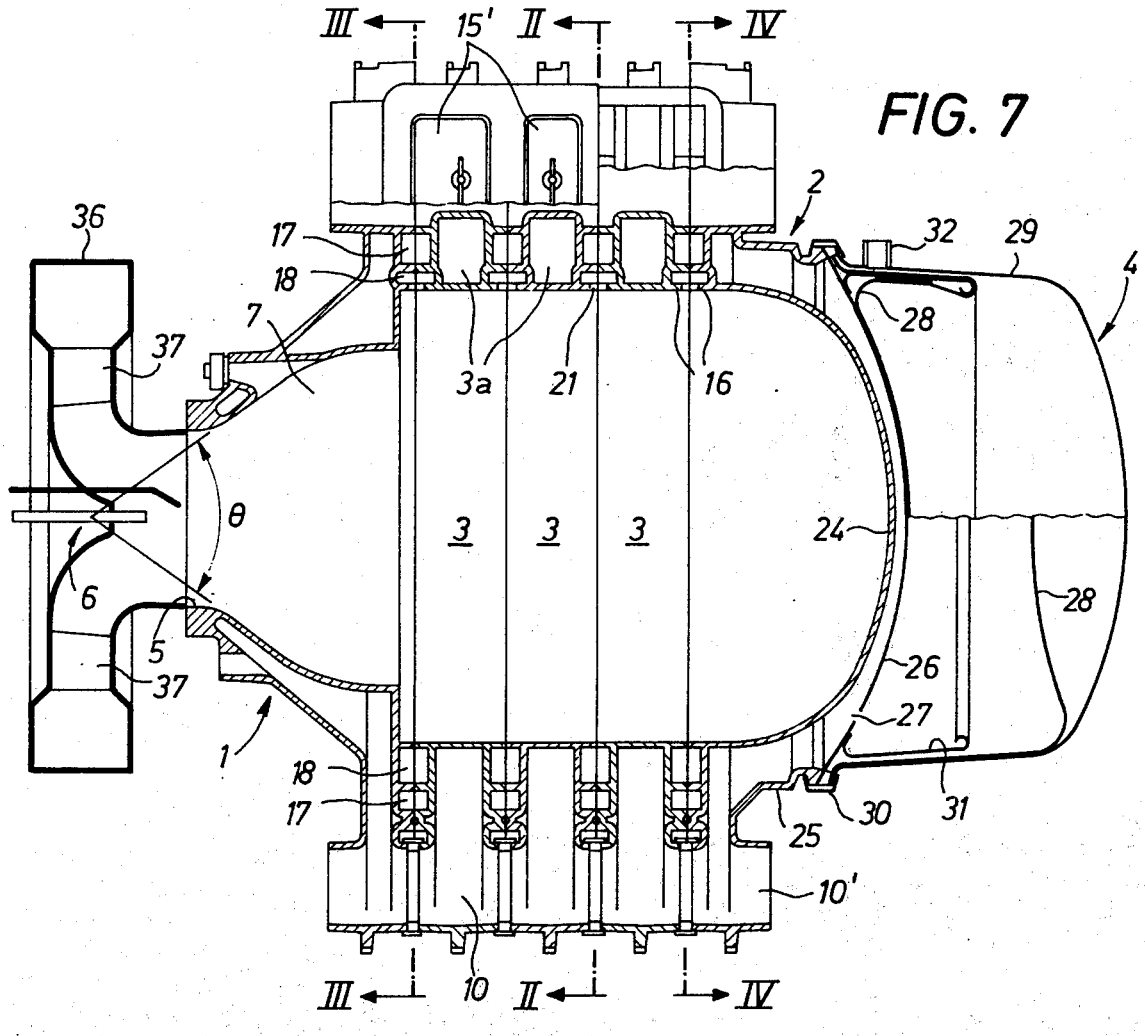
FIG. 7 is a sectional view similar to FIG. 1, of a second embodiment of a boiler according to the invention.

FIG. 7 illustrates another embodiment of the boiler according to the invention in which the rings 13 and 23 of the boiler shown in FIG. 1 have been eliminated in order to simplify the foundry work. In this figure and in the others similar parts have similar reference numerals to those in FIG. 1 in order to allow for more easily comparing the various embodiments. This simplified embodiment, which of course can also be applied to the embodiment of FIG. 8 later herein described, has practically the same operating characteristics as the boiler previously described.

However in this embodiment it is very desirable to use an intense swirl burner designed in such a manner that the swirl number S is greater than about 0.5, this number being defined by the relationship:

$$S = (Gt)/(Gx \cdot R)$$

in which Gt is the value of the angular momentum flux of the flow, Gx is the value of the axial momentum flux of the flow, R is the radius of the outlet mouth of the burner.

As a matter of fact, the elimination of the rings 23 results in the elimination of the axial channels 9 so that the nozzles 21 communicate directly with the combustion chamber 7. Therefore these nozzles 21 could interfere with the internal recirculation of the combustion gases in the event that the movements of the gases are not sufficiently rapid and take place near the walls of the combustion chamber, as is the case when using an axial flow burner and peripheral internal recirculation, thereby decreasing the quality of the combustion.

On the other hand, the intense swirl referred to above produces, along the axis of the burner, a vacuum of reduced pressure zone due to the centrifuging of the flow, which induces movements of axial internal recirculation. This recirculation then is substantially in the form of a toroidal vortex which is removed from the influence of the nozzles 21.

Figure 4:
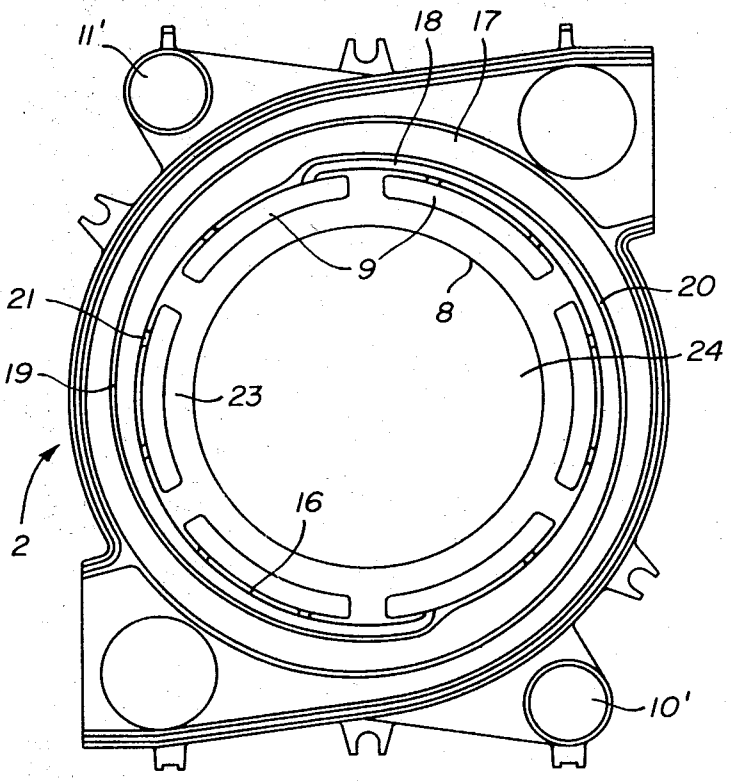
FIG. 4 is a sectional view taken along the section line IV—IV of FIG. 1.
Figure 8:
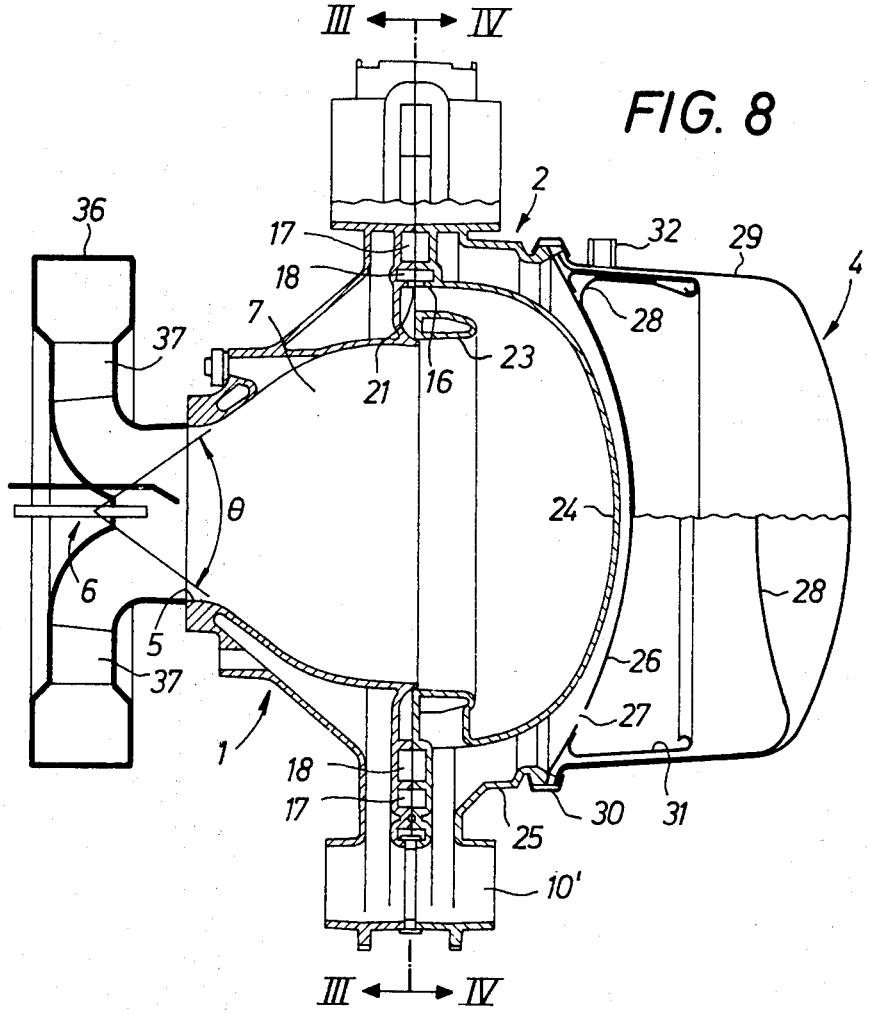
FIG. 8 is a sectional view of a third embodiment of a boiler according to the invention.

The embodiment of a boiler embodying the invention illustrated in FIG. 8 illustrates the smallest boiler which can be made by means of the modular elements, that is to say a boiler formed of the cover 1 and of the bottom 2 without intermediate annular elements 3. Such a boiler has only one pair of convection or heat-transfer channels 17 and 18 formed by the assembling of the cover 1 and bottom 2 of FIGS. 3 and 4 and a single series of nozzles 21 distributed along a plane transverse to the longitudinal axis of the combustion chamber 7. It can be noted that, due to the construction of the boiler, the length of the path traversed by the gases between the combustion chamber and the exhaust is constant, the addition or elimination of modular intermediate elements 3 between the bottom 2 and the cover 1 modifies the number of channels 17 and 18 in parallel and not their length. The total cross section of the path of flow of the gases is therefore proportional to the volume of the combustion chamber, which makes it possible to maintain within the combustion chamber 7 a constant pressure regardless of the power of the installation so that the burner at all times operates under the same pressure conditions.

Figure 6:
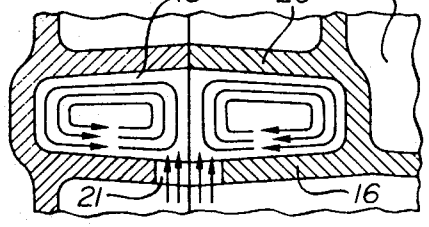
FIG. 6 is a sectional view through a convection or heat-transfer duct shown on a larger scale, in which the secondary movements of the gaseous mixture are shown.
Figure 9:
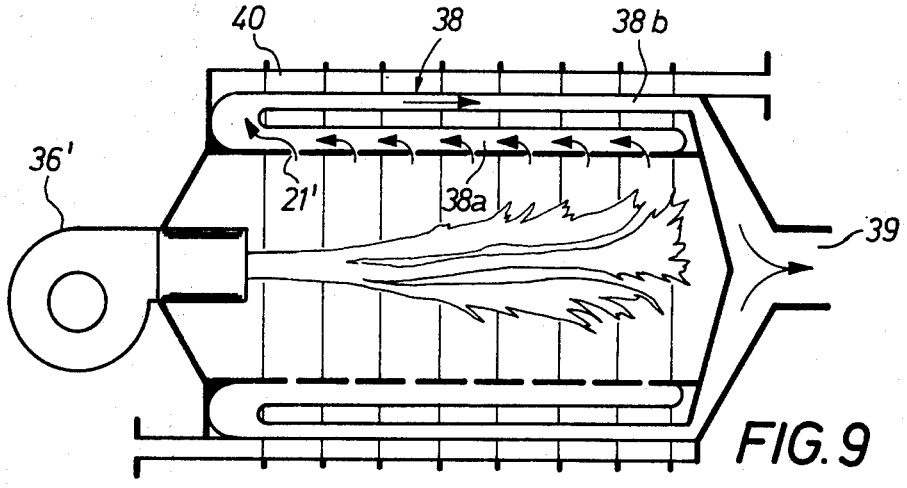
FIG. 9 is a sectional view of a fourth embodiment of a boiler according to the invention.

Although the boiler described and its embodiments derive the utmost advantages from the invention, in particular due to the flow of the gases in parallel around the combustion chamber as well as due to the injection of the gases at the center of circumferential channels as explained in connection with FIG. 6, it is also possible to improve the heat transfer of linear convection channels such as those illustrated in the embodiment of FIG. 9. The boiler in accordance with this embodiment comprises only linear convection channels 38 in the form of a hair pin shape, one branch 38*a* of which is adjacent the combustion chamber. Nozzles 21' are distributed circumferentially equally spaced axially along this branch 38a which constitutes the upstream portion of the channel 38 while the downstream portion 38b extends into an exhaust gas collector 39. This arrangement makes it possible to utilize the advantages of the reinjection of the gases in the convection channels 38 as well as the advantages of a distribution of the nozzles along give axial and circumferential zones assuring a good distribution of the temperature and pressures and an elimination of hot points in the combustion chamber.

The presence of the hair pin convection channels permits the injection of the combustion gases over the entire length of the branch 38a adjacent to the combustion chamber without this injection however taking place too close to the collector 39, which would be equivalent to sending hot gases to the stack. Of course, as a variation thereof, not shown, the two branches of the hair pin 38 could be adjacent the combustion chamber, the nozzles still feeding only the upstream branch. A water circuit 40 is disposed adjacent the convection channels 38 and is intended to be connected at a lower inlet to a supply of cold water while its upper outlet is intended to be connected to a hot water circuit. Preferably, for the same reasons as indicated previously, the burner 36' should be a swirl burner in order to avoid the decreasing in combustion quality due to presence of the nozzles 21' which reduce the peripheral internal recirculation.

What we claim is:

1. A fluid fuel boiler comprising, a combustion chamber, a cover on said combustion chamber having an opening for introducing a combustion supporting gaseous fluid through said opening, a burner for introducing a fluid fuel into the chamber mixed with said gaseous fluid for combustion thereof, water-heating means defining a plurality of water flow paths circumferentially and axially of said combustion chamber, means defining a plurality of axial hot gas flow paths from a downstream portion of said combustion chamber, and means defining a plurality of nozzles for diverting some of said hot gas flow along axially spaced paths in a direction circumferentially of said combustion chamber, and said latter paths being immersed in the flow paths of said water thereby to improve heat transfer.

2. A fluid fuel boiler comprising, a combustion chamber having an opening aligned with a longitudinal axis of said combustion chamber, a burner mounted for introducing a fluid fuel through said opening axially into said combustion chamber, water-heating means defining a plurality of water flow paths circumferentially and axially of said combustion chamber, means for connecting said heating means to a source of cold water, collector means connected to said heating means for collecting hot water flowing through said water flow paths, means defining a plurality of circumferentially spaced axial hot gas flow ducts from a downstream portion of said combustion chamber to an upstream portion of said combustion chamber, means for defining hot gas flow paths comprising convolutions disposed circumferentially of said combustion chamber axially spaced intermediate said water flow paths and next adjacent thereto for heating the water in said water flow paths, means defining a plurality of nozzles for introducing hot gases from said ducts into corresponding hot gas convolutions, and gas collecting means for collecting the hot gases from said hot gas flow paths for exhausting said hot gases after transfer of their heat to water in said water flow paths.

3. A fluid fuel boiler according to claim 2, in which said combustion chamber comprises three substantially circular modules disposed next adjacent each other, said modules comprising said means defining said ducts.

4. A fluid fuel boiler according to claim 2, in which said means defining said hot gas flow paths comprises means defining said convolutions separately, and in which said gas collector means comprises separate gas collectors for collecting gas from said gas flow paths separately.

5. A fluid fuel boiler comprising, a combustion chamber, a cover on said combustion chamber having an opening for introducing a combustion supporting gaseous fluid through said opening, a burner for introducing a fluid fuel into the chamber mixed with said gaseous fluid for combustion thereof, water-heating means defining at least one water flow path circumferentially and axially of said combustion chamber, means defining at least one hot gas flow path from a downstream portion of said combustion chamber circumferentially of said combustion chamber, and means defining nozzles for diverting some of said hot gas flow into said hot gas flow path in a direction circumferentially of said combustion chamber into said hot gas flow path, and said latter path being immersed in the flow path of said water thereby to improve heat transfer.

6. A fluid fuel boiler comprising, a combustion chamber, a through opening on an end of said chamber to receive a burner for introducing into the chamber a mixture of a fluid-fuel and a gaseous combustion supporting agent, means defining at least one water circulation channel connected in operation to a source of cold water, means defining at least one combustion gas circulation channel disposed circumferentially of said combustion chamber and closed at one of its ends while the other end is connectable in operation to an evacuation conduit, means defining a plurality of nozzles whose respective inlet openings communicate with said combustion chamber and having outlet openings discharging into said combustion gas circulation channel, said nozzles being distributed over a portion of the length of said channel extending from its closed end, at least a part of the means defining said water circulation channel and said means defining said gas circulation channel comprising a wall common thereto to obtain an exchange of heat between the gases and the water.

7. A fluid-fuel boiler according to claim 6, in which said combustion chamber is of substantially tubular shape, said opening thereof being disposed concentric to the longitudinal axis of said chamber, a burner to impart to said mixture an intense swirl movement, and means defining several combustion gas circulation channels extending circumferentially around said chamber along planes transverse to the longitudinal axis of said chamber and equidistant from each other.

8. A fluid-fuel boiler according to claim 6, in which said combustion chamber is of substantially tubular shape, said opening being disposed concentric with the longitudinal axis of said chamber, a burner to impart an intense swirl movement to said mixture, said plurality of nozzles being distributed in transverse planes equidistant to each other, the nozzles distributed in a same plane being located at angular distances apart equal to each other.

9. A fluid-fuel boiler according to claim 6, in which at least one cross section of said combustion chamber is a section of revolution, means defining several combustion gas circulation channels extending circumferentially around said section of revolution along planes transverse to the axis of revolution of said chamber, said channels having substantially rectangular cross sections, and said nozzles being disposed to discharge into a middle axial section of the corresponding circulation channels.

* * * * *